United States Patent [19]

Kojima

[11] 4,408,871

[45] Oct. 11, 1983

[54] CONTROL SYSTEM FOR ELECTROSTATIC RECORDING APPARATUS

[75] Inventor: Hiroaki Kojima, Toyokawa, Japan

[73] Assignee: Minolta Camera Kabushiki Kaisha, Osaka, Japan

[21] Appl. No.: 358,377

[22] Filed: Mar. 15, 1982

[30] Foreign Application Priority Data

Mar. 19, 1981 [JP] Japan ..... 56-40875

[51] Int. Cl.[3] ..... G03G 15/00

[52] U.S. Cl. ..... 355/14 R; 355/14 E; 355/14 CH; 355/14 D; 324/458; 358/300

[58] Field of Search ..... 355/14 R, 14 CH, 14 E, 355/3 R, 14 D, 3 CH, 77; 350/6.1, 6.2, 6.7, 6.8; 324/457, 458; 358/300

[56] References Cited

U.S. PATENT DOCUMENTS

| | | | |
|---|---|---|---|
| 3,746,427 | 7/1973 | Foster | 350/161 |
| 3,762,791 | 10/1973 | Fournier et al. | 350/6 |
| 3,788,739 | 1/1974 | Coriale | 355/17 |
| 3,801,182 | 4/1974 | Jones | 350/156 |
| 3,944,323 | 3/1976 | Starkweather | 350/7 |
| 4,000,944 | 1/1977 | Fraser | 355/14 R |
| 4,003,650 | 1/1977 | Courtney et al. | 355/14 R |
| 4,123,135 | 10/1978 | Rabedeau | 350/6.8 |
| 4,125,322 | 11/1978 | Kaukeinen et al. | 355/4 |
| 4,204,725 | 5/1980 | DiStefano et al. | 355/14 CH X |
| 4,248,524 | 2/1981 | Takahashi | 355/14 CH X |
| 4,284,344 | 8/1981 | Okamoto et al. | 355/14 E |
| 4,305,652 | 12/1981 | Dattilo et al. | 355/6 |
| 4,355,885 | 10/1982 | Nagashima | 324/457 X |

*Primary Examiner*—A. C. Prescott

*Attorney, Agent, or Firm*—Jackson, Jones & Price

[57] ABSTRACT

An electrostatic recording and printing apparatus having improved control means for clarity of images created on a photosensitive member is provided. Images can be created by line scanning with a laser beam and a startup control means can control the charge potential of the photosensitive surface to a predetermined value prior to exposure by the laser beam and then, subsequently, both the amount of the laser beam and the surface potential can be controlled during operation to ensure optimum reproduction conditions.

15 Claims, 6 Drawing Figures

CONTROL SYSTEM FOR ELECTROSTATIC RECORDING APPARATUS

BACKGROUND OF THE INVENTION

1. Field of the Invention

The present invention relates to a control system for an electrostatic recording apparatus, and more particularly to a control system for an electrostatic recording apparatus wherein the surface of a photosensitive member which can include a photoconductive layer is line-scanned by use of a laser beam, and an optical fiber tube (OFT) or the like to form a latent electrostatic image on the photosensitive member.

2. Description of the Prior Art

Various reproduction systems have been proposed or provided in recent years which utilize an electrophotographic image forming process for a printer to receive and record electric signals, such as computer output signals or facsimile transmission signals. With printer systems of this type, a moving photosensitive member is line-scanned in one direction (primary scan direction) approximately perpendicular to the direction of movement of the photosensitive member (secondary scan direction) by the use of an OFT (optical fiber tube) or a laser beam to project onto the photosensitive member optical signals converted from the electric signals. The optical signals are subjected to a suitable switching control to form an output pattern of characters or other indicia. A printer of the type described above has various advantages as a nonimpact printer, but since the printer utilizes the electrophotographic image forming process and assembly therefor including a photosensitive member, the printer, unlike conventional impact-type printers, requires an additional control system for producing stabilized output images.

The following U.S. Pat. Nos. 4,305,652, 4,125,322, 4,123,135, 4,003,650, 4,000,944, 3,944,323, 3,801,182, 3,788,739, 3,762,791 and 3,746,427 are cited of general interest to disclose features such as control of the electrostatic development field in a copier by an electrometer probe and the use of lasers.

There is still a need in the prior art to optimize the advantages of a laser application for electrophotographic reproduction and printing.

SUMMARY OF THE INVENTION

A main object of the present invention is to provide a control system for a printer for producing stabilized images that can be accomplished efficiently in relationship to the operation of the printer.

A further object of the present invention is to provide an optimized surface potential detection and control system to facilitate the use of lasers in electrophotographic reproduction and printing.

Another object of the present invention is to provide a control system which utilizes a line-scan exposure system for forming images in a printer wherein the control for the producing stabilized images can be effected by varying the width of the scan exposure with the operation of the printer and by further efficiently detecting the sensitizing potential of a photosensitive member and the surface potential of the member after the exposure.

More specifically, the present invention provides a control system for use in an electrostatic recording apparatus wherein the surface of a photosensitive member moving in a secondary scan direction is charged and thereafter line-scanned in a primary scan direction with optical signals subjected to a suitable switching control to form a latent electrostatic image on the surface of the photosensitive member. The control system comprises means for detecting the surface potential on the photosensitive member and control means for detecting and controlling the surface potential on that portion of the photosensitive member opposite to the potential detecting means before that portion is exposed to the optical signal. Thereafter exposing that portion of the photosensitive member to optical signals while exercising control relative to the subsequent adjustment of the surface potential of the photosensitive member after the exposure has been made. The line scanning with the optical signals of the present invention being coordinated by the control means with the detection and control of the surface potential.

The features of the present invention which are believed to be novel are set forth with particularly in the appended claims. The present invention, both as to its organization, and manner of operation, together with further objects and advantages thereof, may be best understood by reference to the following description, taken in conjunction with the accompanying drawings.

BRIEF DESCRIPTION OF THE PREFERRED EMBODIMENTS

The following description is provided to enable any person skilled in the electrostatic recording and printing art to make and use the invention and sets forth the best modes contemplated by the inventor of carrying out his invention. Various modifications, however, will remain readily apparent to those skilled in the art, since the generic principles of the present invention has been defined herein specifically to provide an improved and economical electrostatic recording apparatus with improved control of the charge on the photosensitive surface for line scanning.

Figure 1:
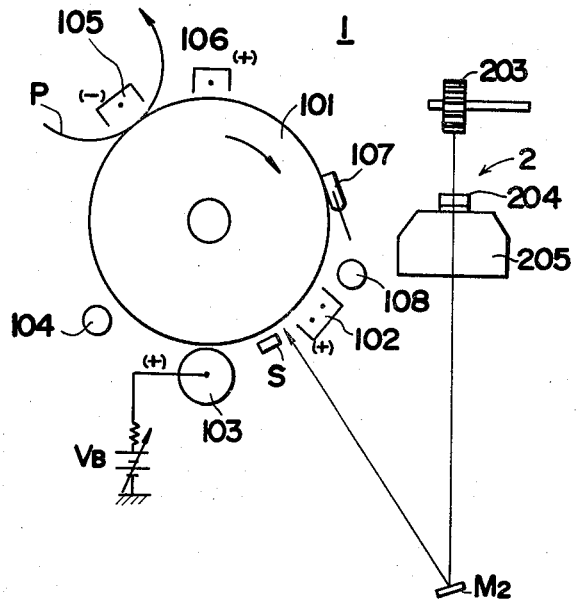
FIG. 1 is a diagram schematically showing a construction of an electrostatic recording apparatus.

FIG. 1 is a diagram schematically showing the construction of an electrostatic recording apparatus in which a laser beam is used for line scanning. This construction is an example of an electrostatic recording apparatus wherein the electrophotographic image forming process of the present invention can be utilized. The construction of the recording apparatus and printing operation will be described hereinafter generally with reference to this drawing.

A printing assembly 1 includes a photosensitive drum 101 which is rotatable in a clockwise direction in FIG.

1. Arranged around the drum 101 are, respectively, a sensitizing charger 102, a surface potentiometer S, a developing unit 103, a suberaser 104, a transfer charger 105, a subcharger 106, a cleaning blade 107, an eraser lamp 108, etc. During the rotation of the photosensitive drum 101, the surface of the drum 101 is uniformly charged by the sensitizing charger 106 to be subsequently irradiated with a laser beam from the laser beam projecting assembly 2, as will be described later, to form an image pattern of indicia characters or the like. Toner (not shown), which has been charged to the same polarity as the sensitizing charge, is deposited on the laser beam projected or exposed portion by the developing unit 103 to which a bias voltage $V_B$ of the same polarity as the sensitizing charge is applied. The toner image thus obtained by reversal development is transferred onto recording paper P by the transfer charger 105 having a polarity opposite to that of the sensitizing charge to form a visible image on the paper P. The paper P with the toner image is then sent to an unillustrated fixing unit, in which the toner image is fixed to the paper P, whereupon the printing operation is completed.

Since the photosensitive drum 101 after the transfer, has been charged by the transfer charger 105 to the polarity opposite to that of the sensitizing potential over the entire width of the drum, the drum will differ in potential between that portion of the drum thereof having the same width as the recording paper P and the other portions of the drum. To eliminate any adverse effect that would result from the subsequent cleaning and optical erasing steps, the drum 101 is charged by the subcharger 106 to a surface potential of the same polarity as the toner and thereafter acted on by the cleaning blade 107 and the eraser lamp 108 for the removal of any residual toner and charges. The drum 101 is then ready to be subjected to the sensitizing step again for another reproduction cycle.

Figure 2:
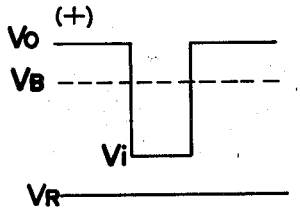
FIG. 2 is a diagram for illustrating reversal development of a latent electrostatic image.

With reference to FIG. 2, the relationships of the sensitizing potential Vo, the exposure potential Vi and the developing bias voltage $V_B$ relative to one another will now be described, assuming that the sensitizing potential Vo is of a positive polarity in the present embodiment.

The surface of the photosensitive drum 101 is initially charged by the sensitizing charger 102 to a potential Vo, which then drops to Vi when the drum is irradiated with a laser beam. In this state, the developing bias potential $V_B$ is set to such a level that $Vi < V_B < Vo$ since the developing toner is positively charged. At this time, the voltage $V_B$–Vi relates to the density of the toner image, and the voltage Vo–$V_B$ relates to the possible fogging of the toner image. The characteristics of the photosensitive drum can alter as a result of variations in temperature, fatigue due to continuous use, etc., consequently providing variations in the initial sensitizing potential Vo or in the potential Vi of the exposed portion, accordingly the deposition of toner on the nonimage areas (fog) or the variation of toner image density is likely to occur if the voltage of the sensitizing charger 102 or the developing bias $V_B$ is constant. Assuming that a selenium-type photoconductive material of a type known in the prior art is used for the photosensitive drum of the present invention and that $Vo \approx 300$ V, $V_B \approx 200$ V and $Vi \approx 50$ V. In this case, when the voltage $Vo - V_B$ decreases to less than 70 V owing to a drop of the sensitizing potential Vo, fog will result, whereas if Vo increases to about 450 V or higher, the carrier in the developer will adhere to the drum. Further, if the exposure potential Vi rises to reduce $V_B - Vi$, toner images of proper density will not be obtained.

According to the present invention, therefore, the potential Vo or Vi is measured by the surface potentiometer S to control the sensitizing voltage of the sensitizing charger 102 and the developing bias $V_B$ or the amount of impacting light of the laser beam to be described later, to thereby elminate the above-mentioned objections.

Figure 3:
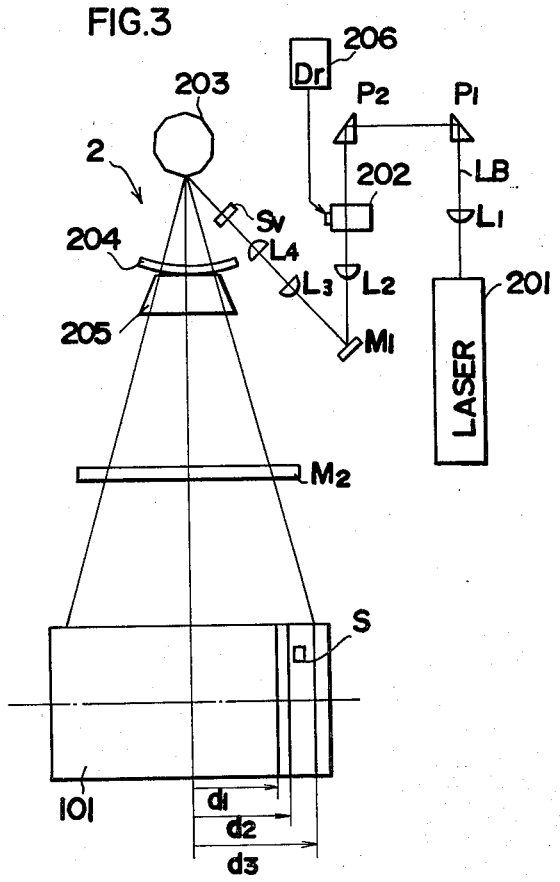
FIG. 3 is a diagram schematically showing the construction of a laser optical assembly for use in an electrostatic recording apparatus.

FIG. 3 is a plan view schematically showing a construction of the laser beam projecting assembly 2 for application in the present invention. A laser beam, LB, from a laser source 201 is diametrically constricted by a focusing lens L1, to be reflected from prisms P1, P2 and caused to impinge on an audio-optical modulating element (A.O. element) 202 (ACOUSTO-OPTIC MODULATOR; commercial model of Nippon Electric Co., Ltd.). The primary light diffracted by the element 202 is spread to the initial beam diameter by a lens L2. The beam is further diametrically enlarged by lenses L3, L4 and caused to strike on a polyhedral (e.g., decahedral) mirror 203 rotating at a high speed. The photosensitive drum 101 is line-scanned with the beam utilizing an angle of deflection resulting from the revolution of the faces of the polyhedral mirror 203. At this time, the tilt error angle (deflection of scan on the surface of the photosensitive drum) of the laser beam LB is corrected and the rays of the beam are made parallel by a cylindrical lens Sv and a toroidal lens 204. The beam is projected onto the drum 101 by a lens system 205 and a reflecting mirror M2. When the angular speed of scanning of the beam LB is constant with the scan speed on the focal plane made constant, the lens system 205 is adapted to provide a relationship between the height of image y and the angle of scanning $\theta$ of $y = f \cdot \theta$.

With the above arrangement, the laser beam LB can be modulated and subjected to switching control by the A.O. element 202 in a suitable timed relationship with the speed of rotation of the drum 101 to form a pattern of desired characters, etc. on the drum 101. The A.O. element 202 utilizes the regular unevenness of density, i.e. a space phase lattice, in a substance, which can be produced in the substance by the propagation of ultrasonic waves through the substance to bend the optical path for the laser beam LB and perform a switching operation. Furthermore, the amount of light of the beam LB reaching the drum 101 can be adjusted by controlling the gain of the A.O. element 202 by an A.O. driver 206. Accordingly, the variation of the potential Vi of the exposed portion can be compensated for by adjusting the amount of light of the laser beam through the A.O. element 202.

With reference to FIG. 3, indicated at d1, on the drum surface 101, is a predetermined width of a region of effective development, at d2 the maximum width of the recording paper P, at d3 the width of the region of effective sensitizing by the sensitizing charger 102, and also at d3 the maximum predetermined width of scan by the laser beam LB, as measured from the midpoint of the axial length of the photosensitive drum 101. It is preferable that the surface potentiometer S be positioned within the width d3 outside the width d2 as illustrated. If the potentiometer S is so positioned, the potential Vo or Vi can be detected as desired for controlling the sensitizing charger 102 or the A.O. driver 206 when the apparatus is set for a printing operation as well as when it is set for a control mode. As can be appreciated, the photosensitive drum 101 is only illustrative of one embodiment of this invention and other forms of photosensitive elements can be used.

Figure 4:
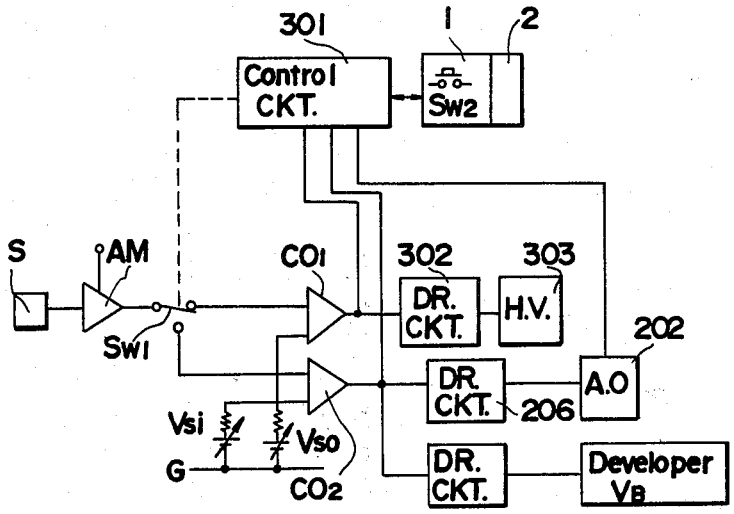
FIG. 4 is a circuit block diagram showing a specific embodiment of a control system of the present invention.

FIG. 4 is a block diagram showing the circuit for the control system of the present invention for illustrative purposes. The output of the surface potentiometer S is fed to a comparator C01 or C02 by way of a switch SW1 for the alternative detection of Vo or Vi. The comparator C01 is an analog comparator for controlling the sensitizing potential Vo by comparing a detected potential Vo with a standard voltage Vso and giving an output which varies with the difference therebetween. Similarly, the comparator C02, for controlling the potential Vi of the exposed portion, compares a detected potential Vi with a standard voltage Vsi.

For control operation, the photosensitive drum 101 is initiated into rotation, for example, by closing a start switch SW2 for the printing assembly 1 or in response to a start signal from a computer. With the sensitizing charger, eraser and like units initiated into operation, a control circuit 301 is energized, and the switch SW1 is turned on for the comparator C01. At this time, the laser 201 is held out of operation. Alternatively, when the laser is in operation for forming an image, the laser beam LB is subjected to switching control by the A.O. element 202 so as to scan the drum 101 over the width d1 or d2 without exposing to the laser beam that portion of the drum opposed to the surface potentiometer S. Accordingly, the potentiometer S detects an initial or startup sensitizing potential Vo, which is compared with the standard voltage Vso by the comparator C01. The output resulting from the difference controls a driver 302 for a high-voltage power supply 303 for the sensitizing charger 102 until Vo becomes equal to Vso, whereupon the comparator C01 delivers "1" output. This output is fed to the control circuit 301, causing the laser beam LB to scan the drum fully over the width d3 or over the width d3−d2 only. After a predetermined time delay to allow the exposed drum portion to reach the location of the potentiometer S, the switch SW1 is closed to activate the comparator C02. The potentiometer S not detects the potential Vi resulting from exposure by the laser beam. This potential is then compared with the standard voltage Vsi by the comparator C02. The difference output controls the driver 206 for the A.O. element 202 until Vi becomes equal to Vsi, whereupon the operation for detecting Vo is conducted again. Alternatively, the control system can be passively held out of a detecting operation for a specified period of time.

The detecting and control operation can also be conducted during the usual printing operation when the potentiometer S is positioned within the drum width d3 outside the width d2 as described above. In this case, a suitable control mode can be set which is executed before the start of the printing operation. Alternatively, such an operational control mode may be executed automatically with the start of a printing operation. Further alternatively, a timer may be set to execute the control mode at a predetermined time interval. When the developing bias $V_B$ is controlled in accordance with the output of the comparator for effecting such control during printing, toner images free from fog can be obtained with a satisfactory density at all times to ensure optimum image reproduction conditions.

Figure 5:
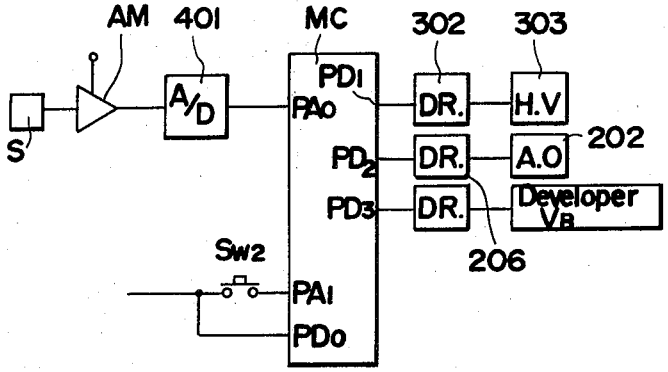
FIG. 5 is a circuit block diagram showing another embodiment of the present invention wherein a microcomputer is used.
Figure 6:
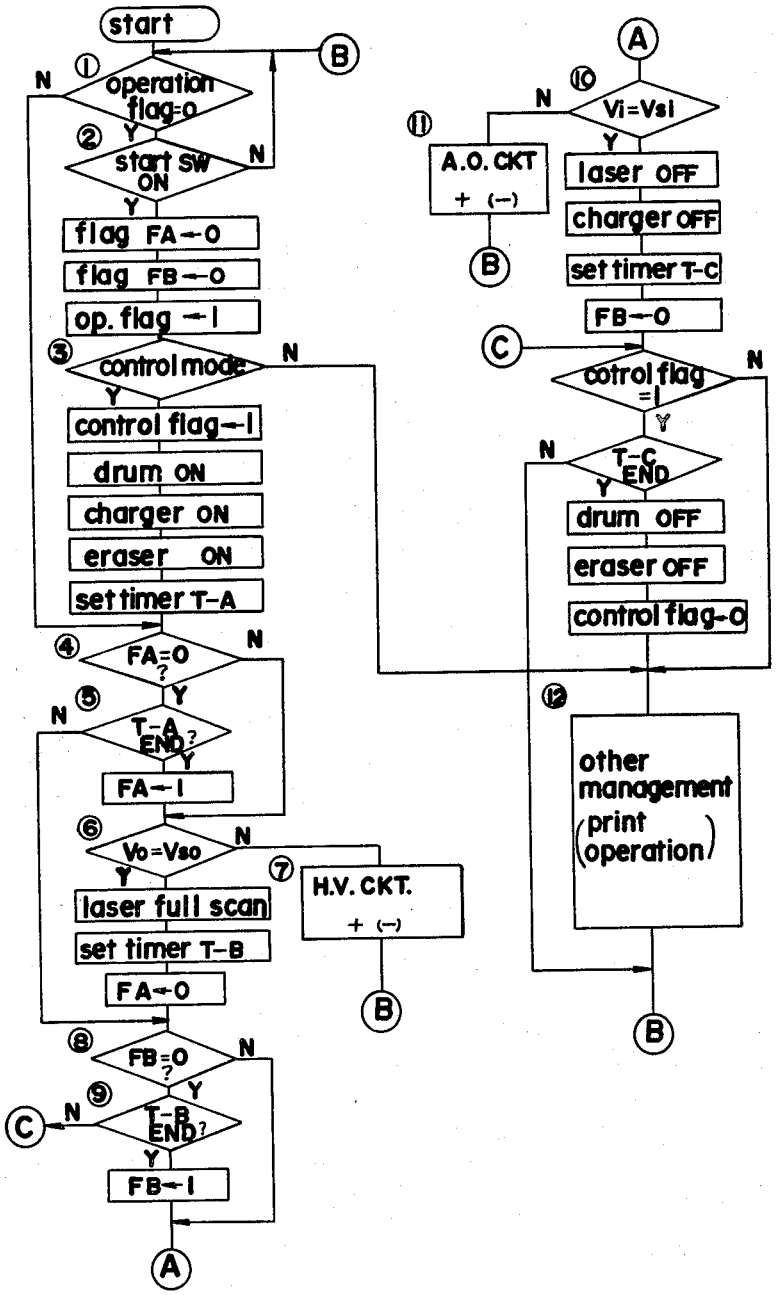
FIG. 6 is a program flow chart showing the processing steps to be performed by the microcomputer of FIG. 5.

FIG. 5 is a block diagram schematically showing an alternative circuit wherein a microcomputer, MC, is used for the control described above. FIG. 6 is a program flow chart showing the processing steps to be performed by the microcomputer.

With reference to FIG. 5, the output of the potentiometer S is connected to an input port PA0 of the microcomputer MC via an amplifier AM and an A-D (analog-digital) converter 401. An input port PA1 receives an ON signal from the start switch SW2 or a start signal from the computer. Output ports PD1, PD2 and PD3 deliver signals for controlling the high-voltage power supply 303 for the sensitizing charger 101, the A.O. element 202 and the developing bias VB, respectively.

The flow chart of FIG. 6 shows the control operation steps to be performed within the microcomputer MC. The chart illustrates an exemplary case wherein the printing operation and the operation for controlling the surface potential, etc. are carried out with different timing periods.

Step 1 checks an operation flag which is "1" while the recording apparatus is in operation. If the flag is "0," step 2 detects the closing of the start switch SW2 (input of a start signal). When the start signal is emitted, the operation flag is changed to "1, " and flags FA and FB, relating to the operation for controlling the potentials Vo and Vi to be described later, are changed to "0."/

When the start signal is given, step 3 checks whether the recording apparatus is set for a control mode or a usual printing mode. When it is in the control mode, a control flag is changed to "1," the drum 101, the charger 102 and the eraser 108 are initiated into rotational operation, and a timer T-A is set. When not in the control mode, the apparatus starts the usual printing operation (see the description of printing operation with reference to FIG. 1).

The control mode may be selected in step 3 by the user by turning on a suitable switch, or automatically by turning on the power supply or in response to a timer signal or like signal at a predetermined time interval. When the control mode is selected automatically, a control mode start signal is checked instead of the start signal in step 2. The timer T-A is set in step 3 for setting some time delay needed for initiating the surface potential control operation after the drum 101, the charger 102, the eraser 108, etc. have been appropriately brought into operation. More specifically, this delay is the period of time necessary for that portion of the drum 101, illuminated by the eraser 108, to reach the location of the potentiometer S with the rotation of the drum 101. It is desirable to initiate the control operation after the drum 101 has been rotated at least one turn with the suberaser 104, the transfer charger 105 and the subcharger 106 also energized.

Step 4 checks the flag FA for starting the operation for controlling the sensitizing potential Vo. This flag is set to "1" upon the lapse of time set on the timer T-A in step 5. When the flag FA is "1, " the potential Vo detected by the potentiometer S is compared with the standard voltage data Vso stored in a memory (not shown). Unless Vo is equal to Vso, the high-voltage power supply control circuit 302 is controlled in step 7. The comparison is repeated for control until Vo equals Vso.

When Vo=Vso, the flag FA is changed to "0" to complete the Vo detecting operation. At the same time, the laser beam LB is controlled for full scan or for scanning the aforementioned width d3−d2. A timer T-B is set for providing some time delay needed for subsequently initiating the operation for controlling the potential Vi on the exposed portion. As is the case with the timer T-A, the time set on the timer T-B is that amount of time required for the drum portion exposed to the laser beam LB to reach the location of the potentiometer S.

Step 8 checks the flag FB for starting the operation which controls the potential Vi on the exposed portion of the drum. This flag is set to "1" when the time set on the timer T-B has elapsed in step 9. When the flag FB is "1," the potential Vi detected by the potentiometer S is compared in step 10 with standard voltage data Vsi stored in an unillustrated memory. In step 11, the driver 206 for the A.O. element 202 is controlled for adjusting the amount of light of the laser beam LB until Vi becomes equal to Vsi.

When Vi has become equal to Vsi, the flag FB is changed to "0" to complete the Vi detecting operation. The laser 201 is turned off, or the scan of that portion of the drum width d3−d2 is terminated, the chargers are turned off, and a timer T-C is set. The timer T-C is provided for stopping the drum 101 after the charges on the surface of the drum have been removed following the termination of the control operation, in preparation for printing.

Step 11 generally indicates the usual printing operation of the recording apparatus.

Although the flow chart described above illustrates a case wherein the potential control operation and the printing operation are conducted with different timings, the potential is controllable also during the printing operation as already described. Since the drum, the chargers, the eraser, etc. are all in operation in this case, the control of rotation of the drum 101, the on-off control for the chargers, eraser, etc. are eliminated from the steps shown in FIG. 6, and the portion of the drum width d3−d2 is scanned by the laser beam LB in operative relation with the detection and control of Vo and Vi. If the developing bias $V_B$ is controlled while the potential is thus controlled during the printing operation, toner images free from fog can be obtained with a stable density.

While the potential Vi on the exposed portion is controlled in the above embodiments by controlling the gain of the A.O. element and thereby adjusting the amount of light of the laser beam LB, the potential may be controlled alternatively with the use of a light transmittance controlling element, such as an EC (electro chromic device), which can be disposed in the optical path for the beam.

Thus the invention described above provides a control system for use in an electrostatic recording apparatus and printing wherein the surface of a photosensitive member moving in a secondary scan direction is charged and thereafter line-scanned in a primary scan direction with optical signals subjected to suitable switching control to form a latent electrostatic image on the surface of the photosensitive member. The control system comprises means for detecting the surface potential on the photosensitive member, and control means for detecting and controlling the surface potential on that portion of the photosensitive member opposite to the potential detecting means before that portion is exposed to the optical signal, thereafter exposing that portion of the photosensitive member to optical signals and executing control relating to the surface potential of the photosensitive member after the exposure is thus made. The subsequent line scan with the optical signals is adjusted by the control means in accordance with the detection and control of the surface potential. The control system therefore advantageously utilizes the line-scan exposure, for example, by a laser beam, for forming images to control the surface potential on the photosensitive member and thereby efficiently produces toner images with a stabilized density and free from fog.

As can be readily appreciated, it is possible to deviate from the above embodiments of the present invention and as will be readily understood by those skilled in the art, the invention is capable of many modifications and improvements within the scope and spirit thereof. Accordingly, it will be understood that the invention is not to be limited by the specific disclosed embodiment but only by the scope and spirit of the appended claims.

What is claimed is:

1. In an electrostatic recording apparatus having a photosensitive member relatively movable in a secondary scan direction, a charging device for charging the surface of the photosensitive member, means for exposing the charged surface of the photosensitive member by line-scanning in a primary scan direction with optical signals subject to a switching control to form a latent electrostatic image, and a control system for controlling the surface potential of the photosensitive member, the control system comprising:

a detecting means for detecting the surface potential of the photosensitive member at a position subsequent to the means for exposing;

first control means for controlling application of charging power to the charging device to regulating the charged potential to a predetermined charging value in response to the detected value of the detecting means in a first situation with the photosensitive member and the charging device in operation and at least that portion of the photosensitive member opposite to the detecting means not being exposed;

second control means for controlling an exposing power of the exposing means after completion of said first control means operation for regulating the surface potential following exposure to a predetermined potential in accordance with the detected value of the detecting means in a second situation with the photosensitive member and the charging device in operation and at least that portion of the photosensitive member opposite to the detecting means is exposed; and a control device for controlling the line-scanning operation of the exposing means and the first and second control means to effect the first and second control operation in that order.

2. A control system as claimed in claim 1, wherein said control device has a switching means for switching from a control operation of the first control means to the control operation of the second control means in accordance with the completion of the first control operation.

3. A control system as claimed in claim 1, wherein said control device has a delay means for delaying the initiation of the detecting operation after completion of the first control operation and the initiation of the operation of the exposing means in the second control operation until the exposing portion on the surface of the photosensitive member reaches the detecting means.

4. A control system as claimed in claim 1, wherein said first and second control means have a comparing means for comparing predetermined exposure surface potential values with the actual values detected by the detecting means.

5. A control system as claimed in claim 1, wherein said exposing means includes a laser beam and means for deflecting the beam of the laser to the photosensitive member during a primary scan direction, line by line.

6. A control system as claimed in claim 5, wherein said exposing means further includes a switching element to provide switching control of said laser beam to the photosensitive member and said control device controls the width of the scanning by controlling the switching element.

7. An electrostatic recording apparatus having a photosensitive member for retaining an image and means for securing the image for subsequent use, comprising:

means for charging the photosensitive member to predetermined surface potentials;

detecting means for measuring the surface potential of the photosensitive member;

means for exposing the photosensitive member to create a desired image;

a start up control means for controlling the charging means for regulating the charged potential to a predetermined charging value in response to the measured surface potential value of the detecting means with both the photosensitive member and the charging device operative and at least that portion of the photosensitive member opposite to the detecting means not having been exposed, and an operational control means for subsequently controlling both the application of charging power to the charging means after exposure of that portion of the photosensitive member opposite to the detecting means, by the exposing means, and further continuing the control of the exposing means during the subsequent creation of desired images to ensure optimum image reproduction conditions.

8. The invention of claim 7 further including switching means for switching from the startup control means to the operational control means upon completion of the startup mode of operation.

9. The invention of claim 7 further including a timer means for delaying the initiation of the operational control means until a startup charge has been established on the photosensitive surface.

10. The invention of claim 8 further including a comparator means for comparing a predetermined surface potential value with the actual value detected by the detecting means.

11. The invention of claim 7 wherein the exposing means includes a laser source for providing a laser beam and means for directing the laser beam in a controlled manner on the photosensitive surface to create images and the operational control means includes means for controlling the intensity of the laser beam in response to the measured surface potential of the photosensitive member.

12. A copier apparatus having a photosensitive member for retaining an image, means for securing the image for subsequent use, and a laser assembly for creating the image by a laser beam impacting the photosensitive member, comprising:

means for charging the photosensitive member to predetermined surface potentials;

detecting means for measuring the surface potential of the photosensitive member and providing a representative signal;

a startup control means for controlling the charging means for regulating the charged potential to a predetermined charging value in response to the measured surface potential value signal of the detecting means with both the photosensitive member and the charging device operative and at least that portion of the photosensitive member opposite to the detecting means not having been exposed to the laser beam, and an operational control means for subsequently controlling the amount of laser beam light impacting the photosensitive member in response to a detecting means signal-generated after that portion of the photosensitive member opposite the detecting means has been exposed to the laser beam.

13. The invention of claim 12 wherein the operational control means includes a driver circuit for the laser beam that is responsive to the detecting means signal for controlling the amount of laser beam light impacting the photosensitive member.

14. A copier apparatus having a photosensitive member for retaining an image, means for securing the image for subsequent use, and a laser assembly for creating the image by a laser beam impacting the photosensitive member, comprising:

means for charging the photosensitive member to predetermined surface potentials;

detecting means for measuring the surface potential of the photosensitive member and providing a representative signal;

a startup control means for controlling the charging means for regulating the charged potential to a predetermined charging value signal of the detecting means with both the photosensitive member and the charging device operative and at least that portion of the photosensitive member opposite to the detecting means not having been exposed to the laser beam, and an operational control means for subsequently exercising control over the amount of laser beam light impacting the photosensitive member and the application of charging potential to the photosensitive surface in response to a detecting means signal generated after that portion of the photosensitive member opposite the detecting means has been exposed to the laser beam.

15. The invention of claim 14 further including a comparator means for providing a first reference signal to compare with the measured representative signal to determine a startup condition for the photosensitive surface and a second reference signal to compare with the measured representative signal after the startup condition has been achieved and to determine an operational condition for creating images on the photosensitive surface, whereby the operational control means assumes control of the copier apparatus.

* * * * *